United States Patent [19]

Stone

[11] Patent Number: 4,729,612

[45] Date of Patent: Mar. 8, 1988

[54] HINGE SUPPORT SYSTEM

[76] Inventor: Allen F. Stone, 4487 NE. 6th Terr., Fort Lauderdale, Fla. 33334

[21] Appl. No.: 19,893

[22] Filed: Feb. 27, 1987

[51] Int. Cl.[4] ..... A47B 95/00

[52] U.S. Cl. ..... 312/109; 312/110; 312/322

[58] Field of Search ..... 312/322, 331, 110, 307, 312/311, 109

[56] References Cited

U.S. PATENT DOCUMENTS

| | | | |
|---|---|---|---|
| 865,114 | 9/1907 | Mapes | 312/110 |
| 941,168 | 11/1909 | Nelson | 312/110 |
| 2,652,305 | 9/1953 | Swedman et al. | 312/307 |
| 2,667,400 | 1/1954 | Wotring | 312/331 |
| 2,723,177 | 11/1955 | Belew | 312/322 |
| 2,774,644 | 12/1956 | Patterson | 312/331 |
| 2,936,206 | 5/1960 | Wilmer et al. | 312/322 |
| 3,339,995 | 9/1967 | Bencene | 312/322 |
| 3,456,995 | 7/1969 | Nyquist | 312/322 |
| 3,703,325 | 11/1972 | Schnarr | 312/307 |

*Primary Examiner*—Victor N. Sakran

*Attorney, Agent, or Firm*—Sprung Horn Kramer & Woods

[57] ABSTRACT

A hinge support system for a cabinet door to prevent the skewing down of the door during movement of the door from the closed position to a retracted position. The system includes pulleys mounted on the side wall so the cabinet with a cable connected around the pulleys and with the ends of the cable connected to the slides for the sliding hinge assemblies.

4 Claims, 3 Drawing Figures

HINGE SUPPORT SYSTEM

BACKGROUND OF THE INVENTION

The present invention relates to cabinets and in particular to a hinge support system for cabinet doors wherein the cabinet doors are of the type which open and retract into the cabinet.

Wide and tall doors that are designed to recess into a cabinet, when opened, have a tendency to fall down when opened 90° and before they can be pushed back into the cabinet. The weight of the doors is unsupported and causes the door to skew downwardly, making it necessary for the door to be picked back up into the plumb position and guided back into the cabinet. The reverse occurs when pulling the door back out to close the cabinet.

This results in difficulty in opening and closing the door and damage to the door edges and the cabinet due to undesired scraping.

Doors of this type can be seen for example in U.S. Pat. Nos: 3,703,325; 3,339,995; 2,936,206 and 3,456,995.

Various types of support systems have been proposed for overcoming this problem and for example in U.S. Pat. No. 2,723,177 a complex mechanical structure is provided for the opening and closing of a safe door.

SUMMARY OF THE INVENTION

The main object of the present invention is to provide a simple yet effective hinge support system which can be utilized in cabinets to avoid the aforementioned skewing problem.

These and other objects of the present invention are achieved in accordance with the present invention by mounting a pulley and cable attachment to the cabinet side walls and tieing each end of the cable to the top and bottom of the door. With this system in place, as the door is pulled open to 90° from the cabinet face, the downward force of the doors weight is held in check and redistributed back to the top of the door via the cable. The door will now slide into and back out of the pocket with no tendency to skew out of plumb. The door can now even receive more weight on its handle edge without adversely effecting its performance.

This system can be advantageously used with all existing cabinet hardware slides and pivoting/retracting hardware which is presently available.

In a particularly advantageous commercial embodiment, the hinge support system in accordance with the present invention is utilized with upper and lower sliding hinges, each having one hinge section fixed to the door, a second hinge section pivotally connected to the first hinge section, a slide track fixed to the side all and a slide member slidably mounted in the slide track and to which the second hinge section is fixed. The hinge support system of the present invention for preventing the downward skewing of the door includes a first pulley rotatably mounted about an axis fixed to the side wall and disposed below the slide track of the upper sliding hinge at a rearward end of the slide track.

A second pulley is rotatably mounted about an axis fixed to the side wall and disposed above the slide track of the lower sliding hinge at a frontward end of the slide track. A cable connected at one end of the slide member of the upper sliding hinge extends in a Z-shape around the first and second pulleys and is connected at the other end to the slide member of the lower sliding hinge.

The cable may include a tensioning spring intermediate at the ends thereof for maintaining a cable in a taut state, if the door were to be lifted up above plumb.

These and other objects and advantages of the present invention will be seen in more detail from the following description of the present invention taken with the attached drawing, wherein:

DETAILED DESCRIPTION OF THE INVENTION

Figure 1:
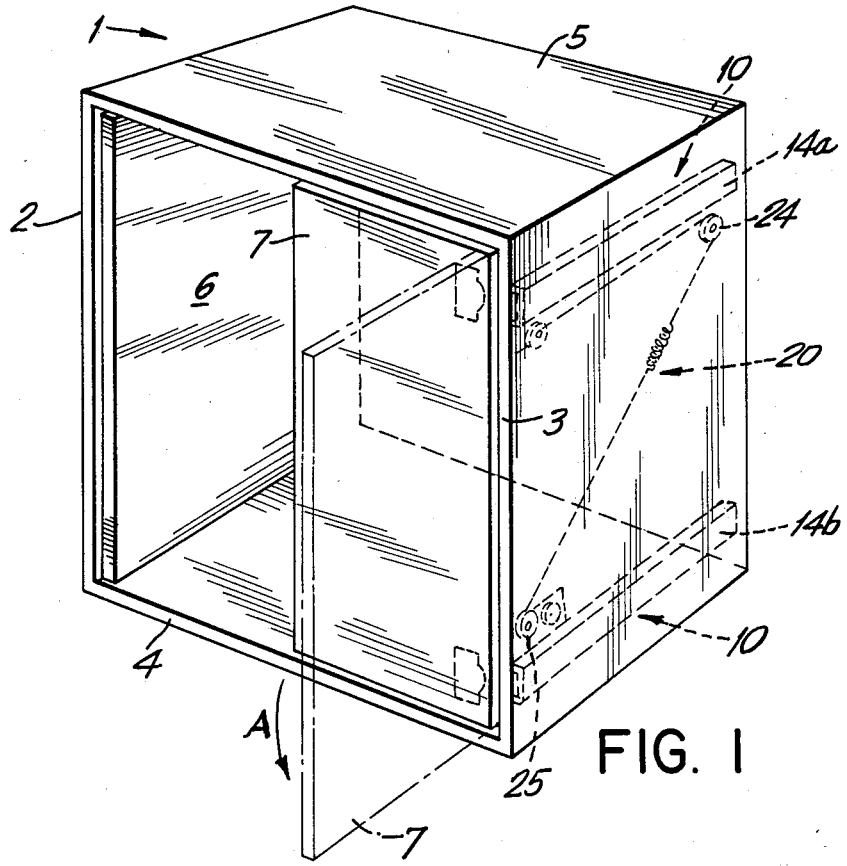
FIG. 1 is a perspective view of a cabinet including the hinge support system according to the present invention.
Figure 3:
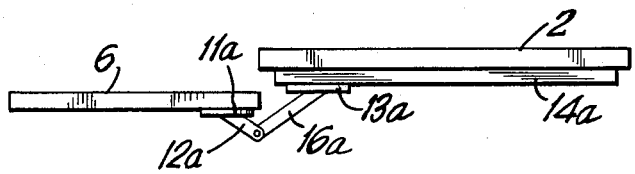
FIG. 3 is a top view of FIG. 2.
Figure 2:
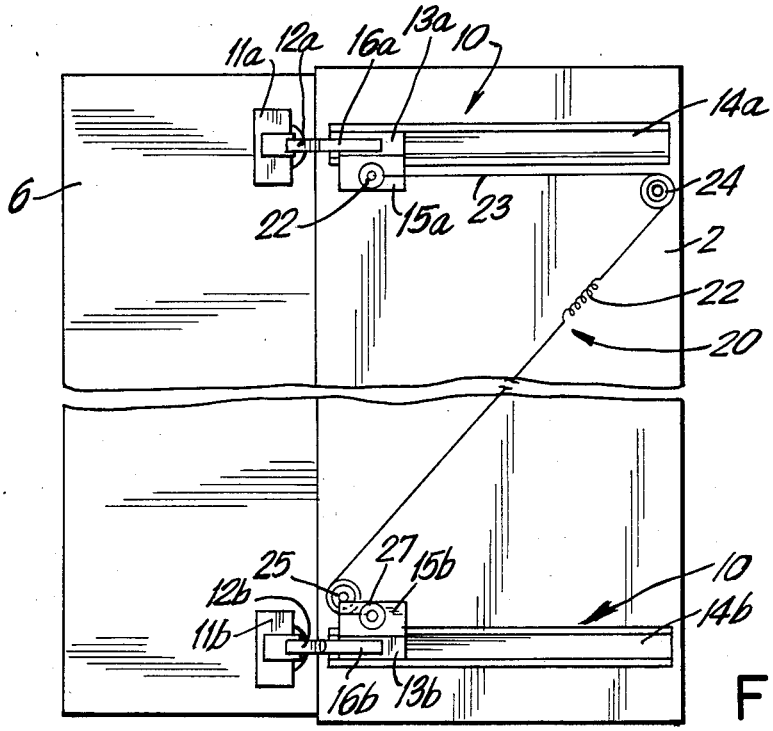
FIG. 2 is a front view of the inside of one side wall of the cabinet of Figure with the door in the opened position.

Referring now to FIGS. 1–3, while the present invention is described with reference to a cabinet 1, it should be clear that the hinge support system of the present invention can be utilized for mounting a door or panel on any similar type of structure where the door or panel is first pivoted and retracted.

The cabinet 1 includes side walls 2, 3, the bottom wall 4 and a top wall 5 and two doors 6, 7. Door 7 is shown in the closed position in solid lines wherein the door 7 is perpendicular to side wall 3 and is shown in the opened position in dotted lines wherein door 7 is parallel to side wall 3. Door 6 is shown in the retracted position wherein it is parallel to side wall 2 and inside the cabinet 1.

The hinge support system for mounting doors 6 and 7 so that they can move between the opened, closed and retracted positions includes sliding hinges 10 and the support mechanism 20 as will be explained in more detail hereinafter.

It should be noted that the sliding hinges are also known as drawer slides and include first hinge sections **11*a*, 11*b* which are fixed to the doors 6, 7. A second hinge section 16*a*, 16*b* which is pivotally connected about pins 12*a*, 12*b* to first hinge sections 11*a*, 11*b* and which are fixedly connected to slide members 13*a*, 13*b*. Slide members 13*a*, 13*b* are slidably mounted on slide tracks 14*a*, 14*b* which include ball bearings for enabling a relatively frictionless sliding of the slides 13*a*, 13*b* forward and backwards along slides 14*a* and 14*b*. Slide members 13*a* and 13*b* also include flanges 15*a*, 15*b***.

Slide hinges 10 including elements **11*a*–16*a* and 11*b*–16*b*** are commercially available slide hinges, for example Grant series 513 Velvet Touch Retract-dor slides from Grant Company, West Nyack, N.Y. 10994.

The means for 20 for preventing the skewing of the doors 6, 7 comprises a first pulley 24 mounted below slide track **14*a* at the rearward portion thereof as shown and a second pulley 25 mounted above slide track 14*b*** at the forward portion thereof as shown.

Also included is a cable 23 which has one end secured via bolt 22 to flange **15*a* and which is guided around pullyes 24 and 25 in a Z-shaped pattern as shown with the other end secured to flange 15*b* by bolt 27. It is important that the end of the cable 23 which is secured to flange 15*b* be disposed behind pulley 25 when the door 6, 7 is in the position shown in FIG. 2, so that the cable does not fall off the pulleys 24, 25**. The location of the cable end at this point, behind the pulley, is necessary so that the weight of the door at the bottom edge of the door is transferred to a point behind the location of the pulley to tension the cable.

The cable 23 may also include a spring 22' intermediate of the ends of cable 23 in order to maintain the cable 23 in a taut state during use.

As a result of the structure shown in FIGS. 1–3, if door 7 when in the position shown in dotted lines in FIG. 1 has the tendency to skew downwardly as shown by arrow A in FIG. 1, this means that slide **13*b* will be trying to move rearwardly. As slide 13*b* tries to move rearwardly, it pulls on cable 23 which in turn pulls on slide 13*a* to move it also rearwardly. Since slide 13*a* is connected via the hinge to door 6, the weight of door 6 will oppose the skewing movement of the door and thus the door will remain in an equilibrium position as shown. Moreover, when it is desired to move the door 6 from the position shown in FIG. 2 to the position shown in FIG. 1, slides 13*a* and 13*b* will move rearwardly and cable 23 will just move along pulleys 24 and 25**. As the door moves into the retracted position the support system will prevent any skewing or movement of one hinge relative to the other.

It will be appreciated that the instant specification and claims are set forth by way of illustration and not limitation, and that various modifications and changes may be made without departing from the spirit and scope of the present invention.

What is claimed is:

1. In a cabinet having side walls, at least one door and means mounting the at least one door for pivotal movement between a closed position wherein the at least one door is perpendicular to one side wall and an open position wherein the at least one door is parallel to the one side walls and for sliding movement between the open position and a retracted position wherein the at least one door is disposed within the cabinet and parallel to the one side wall, the movement means including upper and lower sliding hinges, each having one hinge section fixed to the at least one door, a second hinge section pivotally connected to the first hinge section, a slide track fixed to the one side wall and a slide member slidably mounted in the slide track and to which the second hinge section is fixed, the improvement comprising means for preventing the downward skewing of the at least one door during movement between the closed position and the retracted position including a first pulley rotatably mounted about an axis and fixed to the one side wall and disposed below the slide track of the upper sliding hinge at a rearward end thereof, a second pulley rotatably mounted about an axis and fixed to the sidewall and disposed above the slide track at the lower sliding hinge at a frontward end thereof, a cable connected at one end to the slide member of the upper sliding hinge, extending in a Z-shape around the first and second pulleys and connected at the other end to the slide member of the lower sliding hinge, whereby the two ends of the cable are movable with the at least one door during sliding movement between the open end retracted positions.

2. The cabinet according to claim 1, wherein the cable includes a tensioning spring intermediate of the ends thereof for maintaining the cable in a taut state.

3. A hinge support system for mounting a cabinet door for pivotal movement between a closed position wherein the door is perpendicular to a cabinet side wall and an open position wherein the door is parallel to the side walls and for sliding movement between the open position and a retracted position wherein the door is disposed within the cabinet and parallel to the side wall, the assembly comprising: upper and lower sliding hinges, each having one hinge section fixable to a second hinge pivotally connected to the first hinge section, a slide track fixable to a side wall and a slide member slidably mounted in the slide track and to which the second hinge section is fixed, and means for preventing downward skewing of a door during movement between the closed position and the retracted position including a first pulley rotatably mounted about an axis and fixable to a side wall below the slide track of the upper sliding hinge at a rearward end thereof, a second pulley rotatably mounted about an axis and fixable to a sidewall above the slide track of the lower sliding hinge at a frontward end thereof, a cable connectable at one end to the slide member of the upper sliding hinge, extendable in a Z-shape around the first and second pulleys and connectable at the other end to the slide member of the lower sliding hinge, whereby the two ends of the cable are movable with the at least one door during sliding movement between the open end retracted positions.

4. The hinge support system according to claim 3, wherein the cable includes a tensioning spring intermediate of the ends thereof for maintaining the cable in a taut state.

* * * * *